US010053312B2

(12) United States Patent
Nakagawa

(10) Patent No.: US 10,053,312 B2
(45) Date of Patent: Aug. 21, 2018

(54) SHEET FEEDING APPARATUS AND AN IMAGE FORMING APPARATUS

(71) Applicant: CANON KABUSHIKI KAISHA, Tokyo (JP)

(72) Inventor: Hiroyuki Nakagawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/472,524

(22) Filed: Mar. 29, 2017

(65) Prior Publication Data

US 2017/0283194 A1 Oct. 5, 2017

(30) Foreign Application Priority Data

Apr. 4, 2016 (JP) ..... 2016-075235

(51) Int. Cl.
*B65H 1/14* (2006.01)
*B65H 3/06* (2006.01)
*G03G 15/00* (2006.01)

(52) U.S. Cl.
CPC ..... *B65H 1/14* (2013.01); *B65H 3/0684* (2013.01); *G03G 15/6514* (2013.01); *B65H 2402/441* (2013.01); *B65H 2407/21* (2013.01)

(58) Field of Classification Search
CPC .... B65H 1/14; B65H 3/0684; B65H 2407/21; B65H 2402/64; G03G 15/6514
USPC ..... 271/9.09
See application file for complete search history.

(56) References Cited

U.S. PATENT DOCUMENTS 6,540,220 B2 * 4/2003 Kuo ..... B65H 3/0615 271/110
7,444,112 B2 * 10/2008 Murakanni ..... B41J 13/103 271/9.09
7,611,138 B2 * 11/2009 Fujita ..... B65H 1/04 271/9.01
7,708,265 B2 * 5/2010 Kusama ..... B65H 1/266 271/117
7,748,700 B2 * 7/2010 Nishizawa ..... B65H 1/14 271/147
8,246,044 B2 * 8/2012 Nishitani ..... B65H 1/14 271/126

(Continued)

FOREIGN PATENT DOCUMENTS

JP 09-30658 A 2/1997
JP 2001-019176 A 1/2001
JP 2011-126676 A 6/2011

*Primary Examiner* — Patrick Cicchino
(74) *Attorney, Agent, or Firm* — Fitzpatrick, Cella, Harper & Scinto

(57) ABSTRACT

Disclosed is a sheet feeding apparatus including: a tray unit provided rotatably with respect to an apparatus main body; a sheet stacking member which can be moved to a stand-by position for waiting for sheet feeding and a feeding position at which a sheet can be fed; a moving portion which abuts against the sheet stacking member from below and to move the sheet stacking member to the feeding position and the stand-by position, the moving portion being movable to a first position at which the moving portion locates the sheet stacking member at the stand-by position and to a second position at which the moving portion locates the sheet stacking member at the feeding position; and a restricting portion which restricts movement of the sheet stacking member by interfering with the moving portion located at the first position when the sheet stacking member moves.

13 Claims, 14 Drawing Sheets

(56) References Cited

U.S. PATENT DOCUMENTS

| | | | | |
|---|---|---|---|---|
| 8,820,733 | B2 * | 9/2014 | Arimura | B65H 3/68 271/18.1 |
| 9,067,747 | B2 * | 6/2015 | Kawashima | B65H 1/08 |
| 9,796,541 | B2 * | 10/2017 | Takahashi | B65H 1/04 |
| 2011/0140347 | A1 * | 6/2011 | Nishitani | B65H 1/14 271/157 |
| 2011/0227277 | A1 * | 9/2011 | Wada | B65H 1/266 271/162 |
| 2016/0244284 | A1 * | 8/2016 | Takahashi | G03G 15/6511 |
| 2018/0050878 | A1 * | 2/2018 | Okazaki | G03G 15/6502 |

* cited by examiner

SHEET FEEDING APPARATUS AND AN IMAGE FORMING APPARATUS

BACKGROUND OF THE INVENTION

Field of the Invention

The present invention relates to a sheet feeding apparatus which can be used in an image forming apparatus such as a printer and to an image forming apparatus having the sheet feeding apparatus.

Description of the Related Art

Conventionally, an image forming apparatus such as a printer and a copying machine has a manual feed tray for stacking sheets that is provided at a side surface of the apparatus main body of the image forming apparatus and a manual sheet feeding apparatus which feeds the sheets one by one to an image forming portion. In recent years, with an increase in a speed of a copying machine, a demand for accommodating a larger number of sheets and a demand for diversifying types and sizes of sheets have been strong. Accordingly, it is desired that a large number of sheets can be accommodated in a manual feeding apparatus which can feed various types and sizes of sheets.

Generally, in a manual sheet feeding apparatus, a pickup roller descends towards the upper surface of stacked sheets to feed the sheets. In addition, there is also another manual sheet feeding apparatus in which the upper surface of the stacked sheets is pressed against a feeding roller by urging a sheet supporting plate on which the sheets are stacked in the upward direction and the sheet supporting plate is pushed down by a cam or the like each time the sheets are fed one by one by the feeding roller.

However, due to the constraints of the configuration of these manual sheet feeding apparatuses, there is a limit to the applicable sheet stacking height and it is impossible to accommodate and feed a large number of sheets. In view of this, Japanese Patent Application Laid-Open No. H09-30658 discloses a sheet feeding apparatus which has a sheet stacking tray which is a sheet stacking member which is rotatable about a rotating axis and a lifting portion which rotates the sheet stacking tray when a sheet is fed. In this sheet feeding apparatus, the sheet stacking tray is rotated by driving the lifting portion according to the height of the stacked sheets when a sheet is fed, thereby adjusting a lifting amount of the stacked sheets. With this configuration, sheets can be fed without a problem even if a large number of sheets are stacked on the sheet stacking tray and the height of the stacked sheets has greatly changed during the feeding of a sheet.

Further, the manual sheet feeding apparatus disclosed in Japanese Patent Application Laid-Open No. H09-30658 has a tray unit at which a sheet stacking tray is provided can be accommodated in the apparatus main body.

In the manual sheet feeding apparatus provided with the sheet stacking tray which can be elevated as disclosed in Japanese Patent Application Laid-Open No. H09-30658, the sheet stacking tray is rotatably provided on the tray unit. Thus, when a user tries to lift the sheet stacking tray upwardly, the sheet stacking tray is easily lifted in an amount more than expected, which may cause the disturbance of the stacked sheets. Further, in another configuration in which a side restriction plate is attached to the sheet stacking tray and the side restriction plate is elevated together with the sheet stacking tray, when a user operates the side restriction plate according to the width of a sheet, the sheet stacking tray may be elevated unexpectedly. Furthermore, when the range in which the sheet stacking tray can be rotated is made wide in order to increase a number of stacked sheets, an amount of elevation increases, thereby making the problem more noticeable.

SUMMARY OF THE INVENTION

The present invention provides a sheet feeding apparatus which can prevent a user from lifting a sheet stacking member in an amount more than expected, and an image forming apparatus therewith.

A sheet feeding apparatus of the present invention, comprises:

a tray unit provided rotatably with respect to an apparatus main body, the tray unit being configured to be capable of taking a position at which the tray unit is closed with respect to the apparatus main body and a position at which the tray unit is opened with respect to the apparatus main body;

a feeding portion configured to feed a sheet which is stacked on the sheet stacking member;

a sheet stacking member provided on the tray unit, the sheet stacking member being configured to be capable of being located at a feeding position at which a sheet can be fed by the feeding portion and at a stand-by position which is distant from the feeding position;

a moving portion configured to abut against the sheet stacking member from below and to move the sheet stacking member to the feeding position and to the stand-by position, the moving portion being configured to be movable to a first position at which the moving portion locates the sheet stacking member at the stand-by position and to a second position at which the moving portion locates the sheet stacking member at the feeding position; and a restricting portion provided on the sheet stacking member, the restricting portion being configured to restrict movement of the sheet stacking member from the stand-by position to the feeding position by interfering with the moving portion which is located at the first position when the tray unit is located at the position at which the tray unit is opened.

Further features of the present invention will become apparent from the following description of exemplary embodiments with reference to the attached drawings.

DESCRIPTION OF THE EMBODIMENTS

An image forming apparatus equipped with a sheet feeding apparatus according to embodiments of the present invention will be explained with reference to the drawings.

First Embodiment

<Overall configuration of the image forming apparatus> First of all, the overall configuration of an image forming apparatus equipped with a sheet feeding apparatus according to an embodiment of the present invention will be briefly explained.

Figure 1:
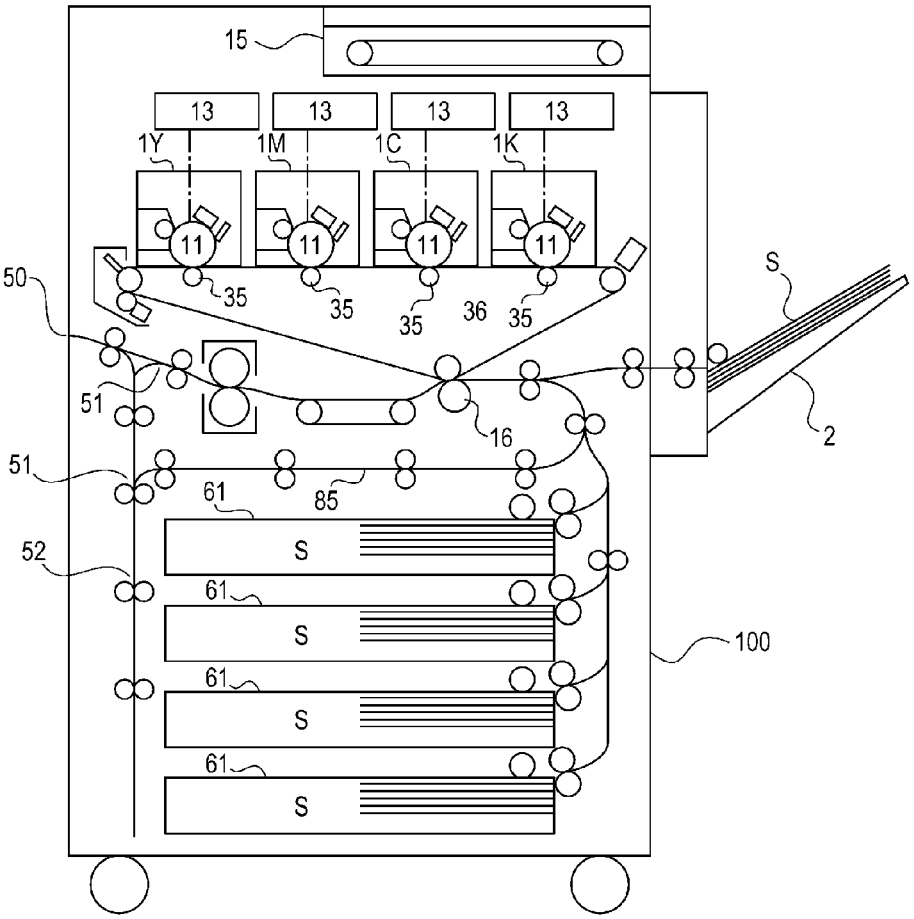
FIG. 1 is a diagram of an image forming apparatus having a sheet feeding apparatus according to an embodiment of the present invention.

The reader portion 15 having an optical scanning system for reading an image is provided at the upper portion of the apparatus main body 100 of the image forming apparatus in FIG. 1. The four image forming portions 1 (1Y, 1M, 1C and 1K) for forming respective color images of yellow (Y), magenta (M), cyan (C) and black (K) are provided below the reader portion 15. A full color image is formed by overlapping these color images.

On the lower portion of the apparatus main body 100, the front loading type feeding cassettes 61 are provided in multiple stages. Each of the front loading type feed cassettes 61 accommodates sheets and is mounted so as to be removable from the front side of the apparatus. Further, on the right side of the apparatus main body 100 in FIG. 1, the manual feeding portion 2 of the type in which a sheet is set on a tray outside the apparatus main body 100 is provided.

The image forming portions 1 of the present embodiment are electro-photographic image forming portions, and each image forming portion has the same configuration except for the color of the toner. Upon image formation, the image information read by the reader portion 15 is photo-electrically converted by the scanner portion 13 and is transferred to the image forming portions 1 where respective toner images are formed on the photosensitive drums 11 in the image forming portions 1. The toner images on the photosensitive drums 11 are transferred to the intermediate transfer member 36 at the primary transfer portion 35 and are conveyed to the secondary transfer portion 16 by the intermediate transfer member 36. At the secondary transfer portion 16, the toner images are transferred to the sheet S sent by the conveying roller from the feeding cassettes 61 or from the manual feeding portion 2. Thereafter, the sheet S is conveyed to the fixing device 5 where heat and pressure are applied and the toner images are fused to the sheet S. Then, when an one-side image formation mode is selected by a user, the sheet S is discharged to the outside of the apparatus from the discharging outlet 50. On the other hand, when a both-side image formation mode is selected by a user, the sheet S is conveyed to the secondary transfer unit 16 again via the reverse path 52 and the both side path 85 by the path switching portion 51.

Figure 2:
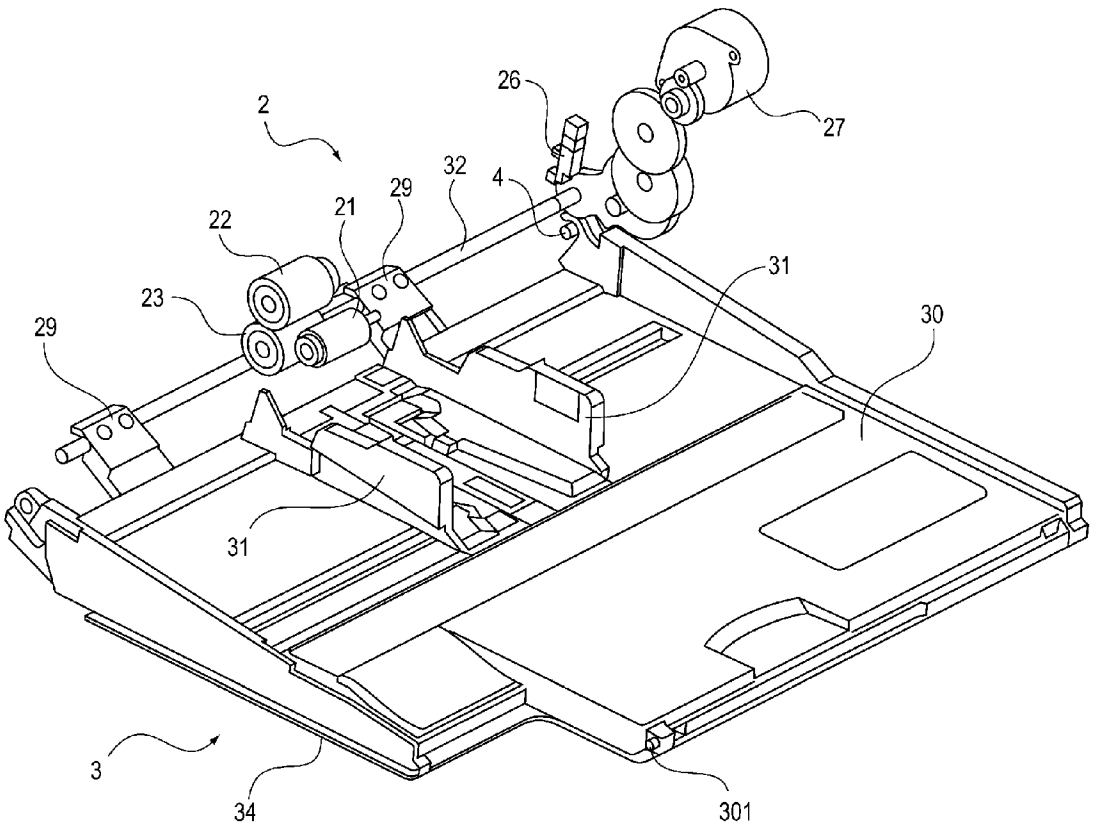
FIG. 2 is an explanatory diagram showing a perspective view of a manual feeding apparatus.
Figure 3:
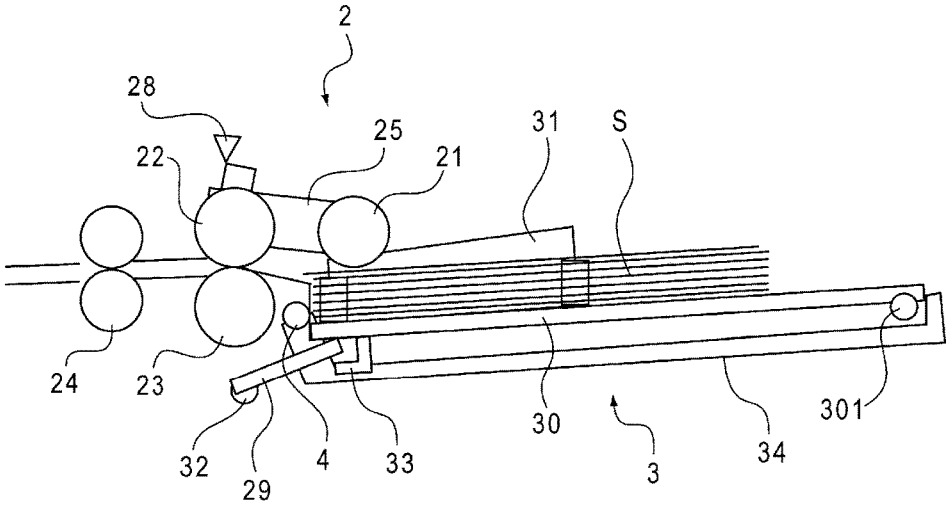
FIG. 3 is a diagram showing a cross-sectional view of a manual feeding portion.

<Sheet feeding apparatus> Next, a sheet feeding apparatus which is a main configuration for the present invention will be explained. Here, in the present embodiment, the sheet feeding apparatus will be explained by exemplifying the manual feeding portion 2. FIG. 2 is an explanatory diagram showing a perspective view of the manual feeding portion 2, and FIG. 3 is an explanatory diagram showing a cross-sectional view of the manual feeding portion 2.

The manual feeding portion 2 has the tray unit 3. The tray unit 3 has the bottom plate (bottom portion) 34 and the sheet stacking tray (sheet stacking member) 30. The bottom plate 34 is configured to be rotatable around the shaft 4 with respect to the apparatus main body 100. Further, the sheet stacking tray 30 is provided so as to be rotatable about the tray rotation shaft 301 with respect to the bottom plate 34. With this configuration, the tray unit 3 can be opened and closed by being rotated about the shaft 4, and can be stored in the apparatus main body 100 when it is not used. When the tray unit 3 is used, the manual feeding portion 2 can be brought into the unfolded state which is shown in FIGS. 2 and 3 by rotating the tray unit 3 which is in the stored state. In the unfolded state, sheets are stacked on the sheet stacking tray 30 (sheet stacking member) provided on the tray unit 3 and are fed to the image forming portions 1 by a feeding portion.

The manual feeding portion 2 includes the pickup roller 21, the feed roller 22, the retard roller 23 and the drawing roller 24 as a feeding portion for feeding a sheet. The pickup roller 21 which feeds the sheets S stacked on the sheet stacking tray 30 is rotatably supported by the pickup arm 25 which rotates around the rotation axis of the feed roller 22. The sheets S fed by the pickup roller 21 are separated and fed one by one by the retard roller 23 which returns the second and subsequent sheets S while being conveyed by the feed roller 22.

Then, the lifter arm (moving portion) 29 rotates and the free end side (the end portion opposite to the rotation shaft 301) is pushed up and rotated so that the height of the stacked sheet surface can be adjusted. The lifter arm 29 which is fixed to the arm shaft 32 to be rotated by the lifter motor 27 rotates around the arm shaft 32. As will be explained later in detail, the lifter arm 29 is configured to be capable to move between the first position where the lifter arm 29 positions the sheet stacking tray 30 at the stand-by position and the second position where the lifter arm 29 positions the sheet stacking tray 30 at the feeding position.

In addition, the manual feeding portion 2 is provided with the sheet surface height detecting sensor 28 for detecting the position of the sheet surface in order to stabilize sheet feeding performance by keeping the sheet surface at a constant height. During the sheet feeding operation, the sheet stacking tray 30 is rotated by the lifter arm 29 thereby raising the sheet surface until the sheet surface height detecting sensor 28 detects the height of the sheets S stacked on the sheet stacking tray 30. At this time, the sheet stacking tray 30 is located at the feeding position where the sheets can be fed and the lifter arm 29 is located at the second position.

Further, the manual feeding portion 2 is provided with the home position sensor 26 as a detecting portion for detecting that the lifter arm 29 is located at the home position. Upon completion of the sheet feeding operation, the lifter arm 29 descends to a predetermined position where the home position sensor 26 detects the lifter arm 29 and waits at the position. That is, the home position (first position) of the lifter arm 29 is the position where the sheet stacking tray 30 is located at the feed stand-by position.

The sheet stacking tray 30 is provided with the side restricting plate (sheet restricting member) 31 for restricting the sheets in the width direction of the sheet (the direction orthogonal to the sheet feeding direction). The side restricting plate 31 plays a role of restricting the skew of a sheet when the sheet is conveyed and is configured to be slidable in the sheet width direction according to the size of the stacked sheets. The side restricting plate 31 is configured to be connected to the sheet stacking tray 30. The term "connected" as used herein refers to a configuration in which when the side restricting plate 31 is lifted upward, the sheet stacking tray 30 also is lifted upward together with the side restricting plate 31.

Figure 4:
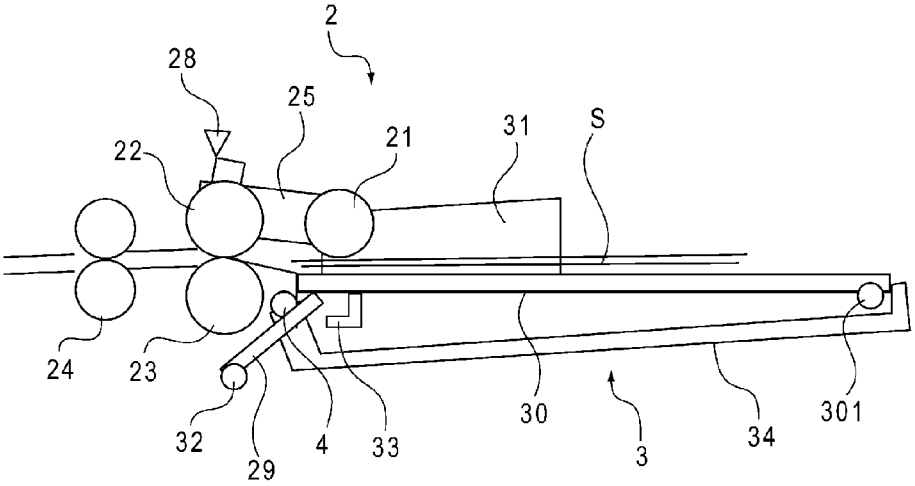
FIG. 4 is a diagram showing a cross-sectional view of a manual feeding portion in a case where a small number of sheets are stacked.

FIG. 4 is a diagram showing a cross-sectional view in the case where the manual feeding portion 2 feeds a small number of sheets which are stacked on the sheet stacking tray 30. When the number of stacked sheets is small, since the sheet stacking height is low, the sheet stacking tray 30 is supported and raised by the lifter arm 29. In this manner, even when the sheet stacking heights are different, the sheet stacking tray 30 is raised by the lifter arm 29 to keep the sheet surface height constant, thereby preventing degradation of feeding performance due to variations in sheet surface height.

<Relationship between the rotation restricting portion and the lifter arm in the sheet stacking tray> The sheet feeding apparatus of the present embodiment is provided with a tray rotation restricting portion so that the sheet stacking tray 30 does not unintentionally rotate. Next, the configuration for restricting the rotation of the tray will be explained.

Figure 5A:
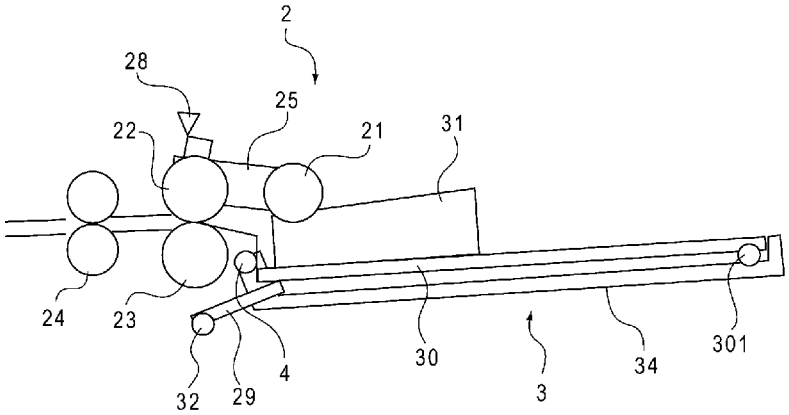
FIGS. 5A and 5B are diagrams showing a cross-sectional view of a manual feeding portion without a locking portion in a stand-by state for a feeding operation.
Figure 5B:
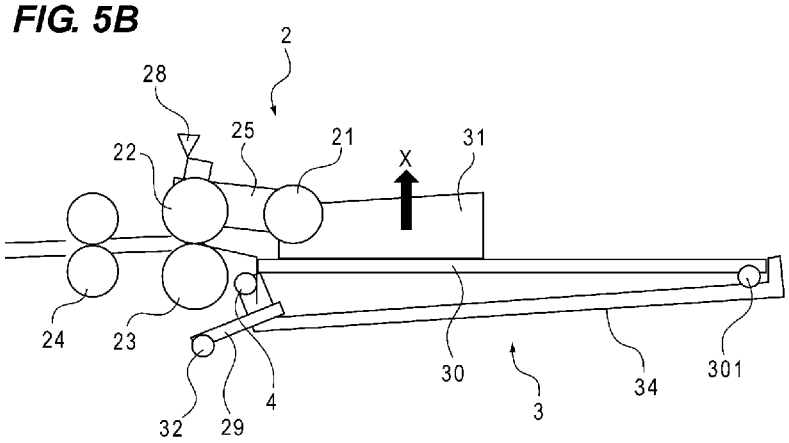

First, the case will be explained where the tray rotation restricting portion is not provided. FIG. 5A is a cross-sectional view of the manual feeding portion without the tray rotation restricting portion in the stand-by state for the feeding operation. The sheet stacking tray 30 is provided so as to be rotatable about the tray rotation shaft 301. The sheet stacking tray 30 is freely rotatable since the sheet stacking tray 30 is not fixed in the rotational direction. Therefore, as shown in FIG. 5B, when the sheet stacking tray 30 receives a force in the vertical direction X of the sheet stacking surface, it is easily lifted up. On the other hand, in the sheet feeding apparatus of the present embodiment, by providing the tray rotation restricting portion, it is possible to prevent the sheet stacking tray 30 from being lifted unintentionally.

Figure 6:
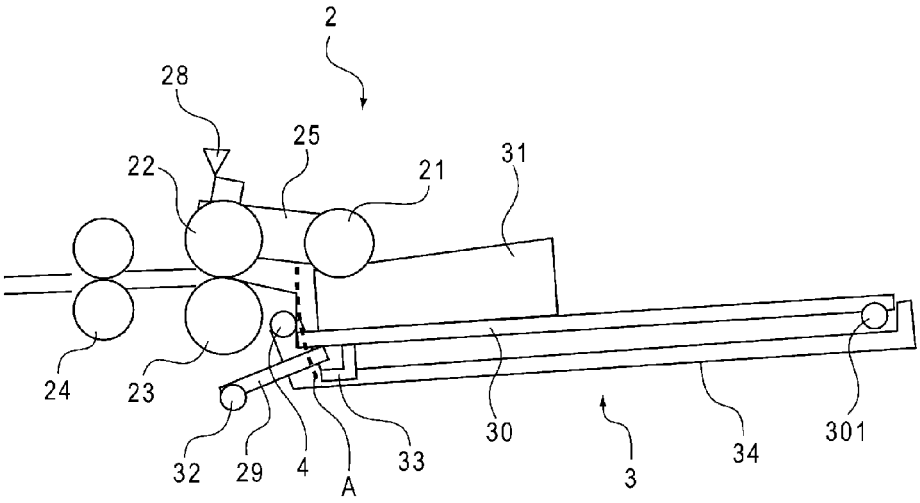
FIG. 6 is a diagram showing a cross-sectional view of a manual feeding portion with a locking portion in a stand-by state of a feeding operation.
Figure 7:
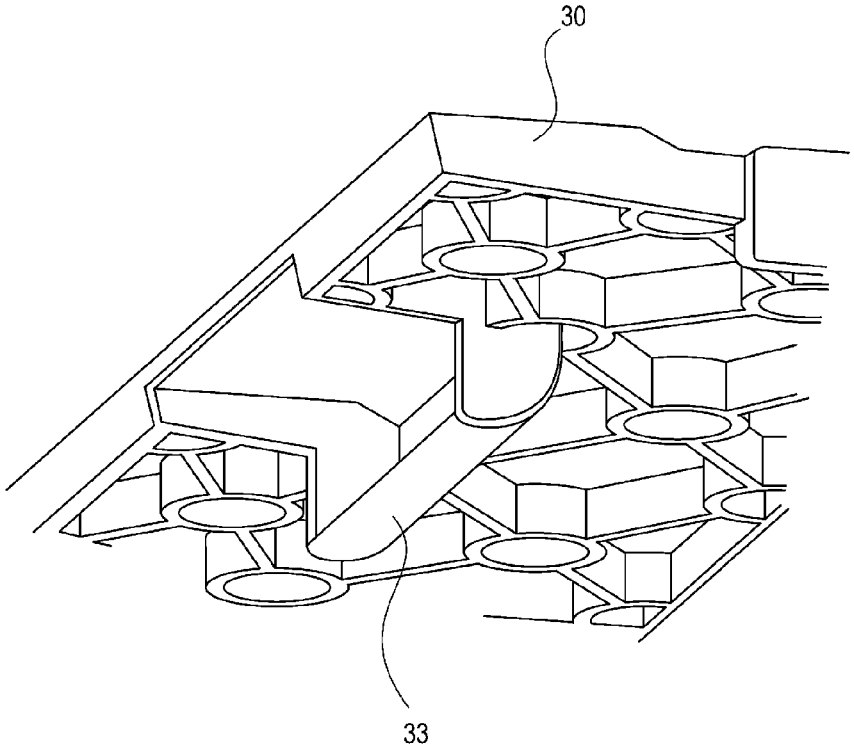
FIG. 7 is an explanatory diagram showing a locking portion of a sheet stacking tray.
Figure 8:
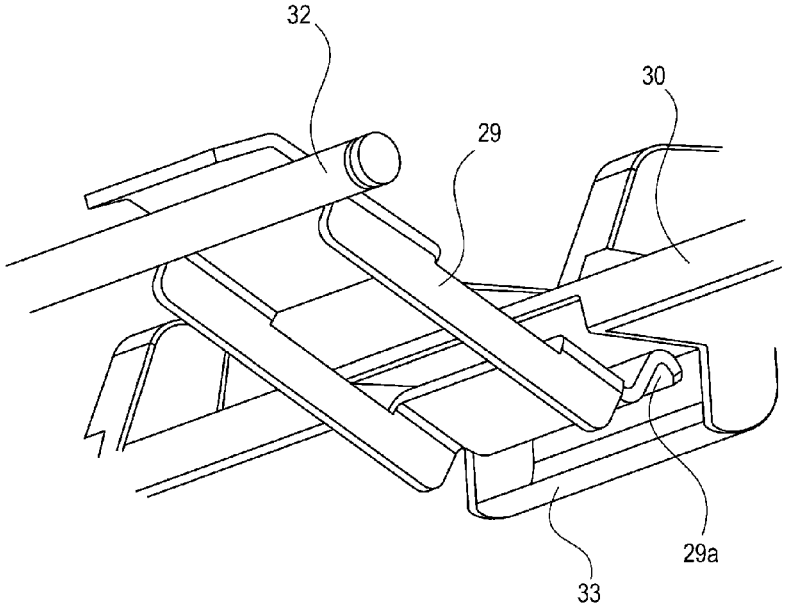
FIG. 8 is an explanatory diagram showing a locking portion and a lifting arm of the sheet stacking tray.

Next, the configuration for restricting the rotation of the tray according to the present embodiment will be explained. FIG. 6 is a cross-sectional view of the manual feeding portion 2 in the stand-by state for the feeding operation in the present embodiment. The locking portion 33 working as a restricting portion for restricting the rotation of the sheet stacking tray 30 is provided at the end portion located at the side of the rotation axis on the lower surface of the sheet stacking tray 30. As shown in FIGS. 7 and 8, the locking portion 33 is provided at the position where the locking portion 33 is opposed to the lifter arm 29 on the lower surface of the sheet stacking tray 30 and is formed in a pocket-like shape with an opening at the side of the lifter arm 29 in order to cover the end portion of the lifter arm 29.

As indicated by the dotted line A in FIG. 6, the locking portion 33 is provided at the position where the movement locus of the end portion of the locking portion 33 interferes with the lifter arm 29 located at the first position when the sheet stacking tray 30 is rotated about the tray rotation shaft 301. Thereby, when the lifter arm 29 for lifting and lowering the sheet stacking tray 30 is located at the first position where the feeding operation is not performed, if the sheet stacking tray 30 is attempted to be rotated, the movement locus A of the locking portion 33 intersects with the lifter arm 29 and they interfere with each other. Therefore, the locking portion 33 abuts against the lifter arm 29 so that the sheet stacking tray 30 cannot rotate. Further, the lifter arm 29 is drivingly connected to the lifter motor 27 via the arm shaft 32 so that the rotation is restricted by the holding force of the motor except for the period of the feeding operation.

Figure 9:
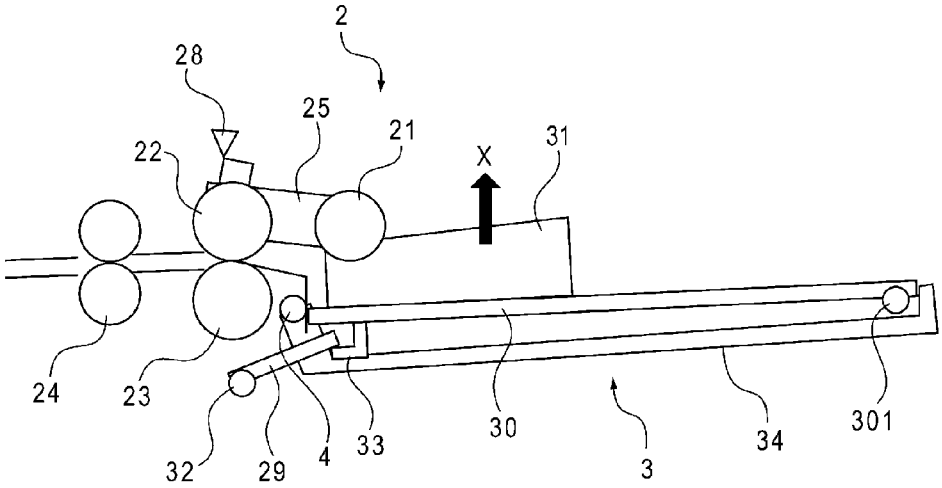
FIG. 9 is an explanatory diagram in the case where a force is vertically applied to the sheet stacking tray.

That is, as shown in FIG. 9, when the sheet stacking tray 30 receives a force in the vertical direction X of the sheet stacking surface, the sheet stacking tray 30 rotates about the tray rotation shaft 301. However, since the locking portion 33 abuts against the fixed lifter arm 29 to restrict the rotation, the sheet stacking tray 30 can rotate only for a small distance corresponding to the gap between the locking portion 33 and the lifter arm 29. Therefore, even if a force for lifting up the sheet stacking tray 30 is applied, it will not be unintentionally lifted.

Further, in the present embodiment, as shown in FIG. 8, the hook portion 29*a* with a hook shape is formed at the end portion of the lifter arm 29. As a result, even if the sheet stacking tray 30 is attempted to be lifted upward, the pocket-like locking portion 33 is engaged with the hook portion 29*a* and is reliably prevented from being lifted.

Next, the relationship between the locking portion 33 and the lifter arm 29 at the time of opening and closing the tray unit 3 will be explained.

Figure 10A:
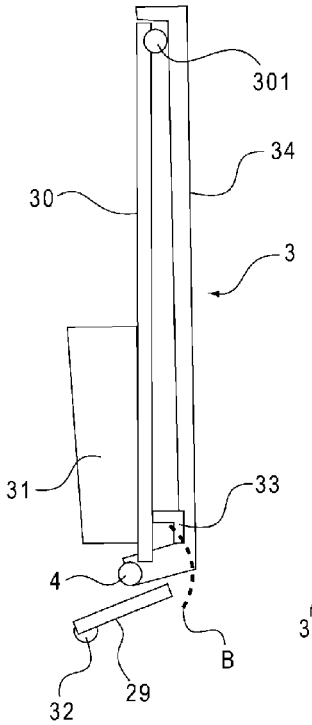
FIGS. 10A, 10B and 10C are explanatory diagrams showing opening and closing operations of a tray unit.
Figure 10B:
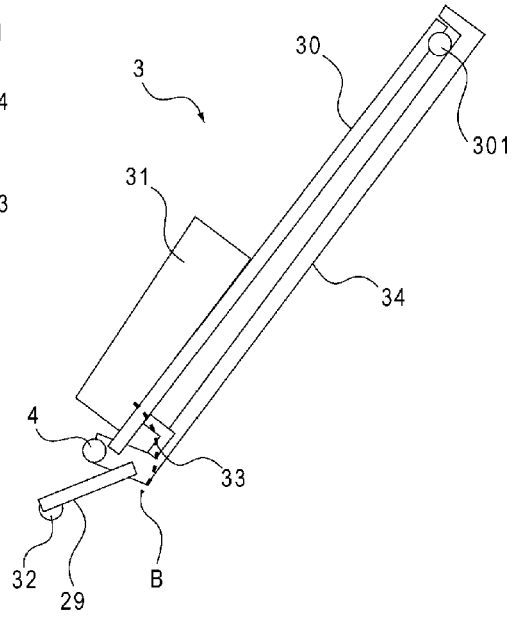
Figure 10C:
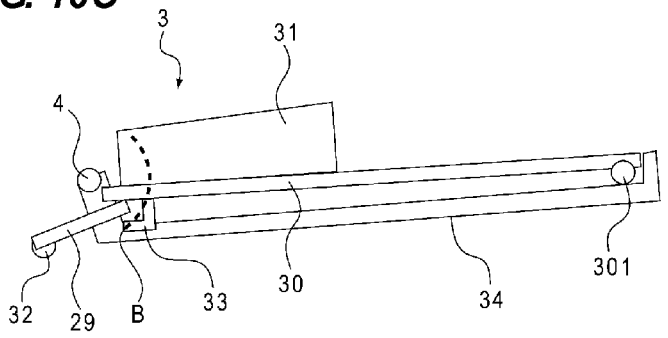

FIGS. 10A, 10B and 10C are diagrams showing processes of an operation of opening the tray unit 3 by rotating it. When the tray unit 3 is opened from the closed stored state (FIG. 10A) of the tray unit 3, the end of the locking portion 33 is rotated on the movement locus B about the unit shaft 4 which is the rotation center of the tray unit. When the tray unit 3 is opened to the tray unfolded state (FIG. 10C) in which the sheets can be stacked through the opening process of the tray unit 3 (FIG. 10B), the lifter arm 29 located at the first position in the stand-by state for the feeding operation is provided at the position at which the lifter arm 29 does not interfere with the movement locus B of the locking portion 33.

That is, the locking portion 33 is located at a position at which the movement locus of the tray unit 3 does not interfere with the lifter arm 29 located at the first position. Therefore, when the tray unit 3 is opened, the locking portion 33 enters the space below the lifter arm 29 without contacting the lifter arm 29. Likewise, when the tray unit 3 moves from the opened position to the closed position, the locking portion 33 does not contact the lifter arm 29. That is, in this case, the locking portion 33 is configured to permit opening and closing of the tray unit 3. On the other hand, in the state in which the tray unit 3 is fully opened, the locking portion 33 contacts the lifter arm 29 and restricts the rotation of the sheet stacking tray 30 only when the sheet stacking tray 30 is lifted by an external force.

As explained above, in the present embodiment, only by providing the locking portion 33 on the sheet stacking tray 30 without adding other parts, it is possible to prevent a user from unintentionally lifting up the sheet stacking tray 30 and to prevent deterioration of the operability and deformation of the components.

Second Embodiment

Next, the configuration of the sheet feeding apparatus according to the second embodiment of the present invention will be explained with reference to FIGS. 11A, 11B and 11C.

In the above-explained manual sheet feeding apparatus according to the first embodiment, when the tray unit 3 is opened, the locking portion 33 rotates about the unit shaft 4 and enters the space below the lifter arm 29. In the present embodiment, as shown in FIGS. 11A, 11B and 11C, the tray unit 3 is attached to the apparatus main body 100 via the opening and closing arm 40 which is a connecting member.

The opening and closing arm 40 is attached to both sides (both sides in the sheet width direction) of the tray unit 3. One end of the opening and closing arm 40 in the longitudinal direction is rotatably attached to the apparatus main body 100 by the unit shaft 4 and the other end is rotatably attached to the tray unit 3 by the second unit shaft 41. That is, the opening and closing arm 40 has the first rotating portion about which the opening and closing arm 40 is rotatable with respect to the apparatus main body 100 and the second rotating portion about which the opening and closing arm 40 is rotatable with respect to the tray unit 3.

The configuration of the sheet feeding apparatus of the present embodiment is the same as that of the above-explained first embodiment except that the tray unit 3 is rotatable to the apparatus main body 100 via the opening and closing arm 40.

Figure 11A:
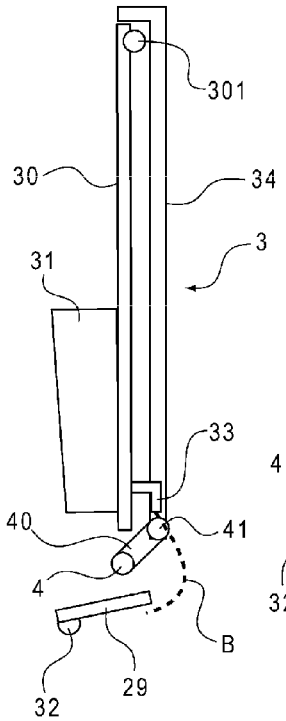
FIGS. 11A, 11B and 11C are explanatory diagrams showing opening and closing operations of the manual tray according to the second embodiment of the present invention.
Figure 11B:
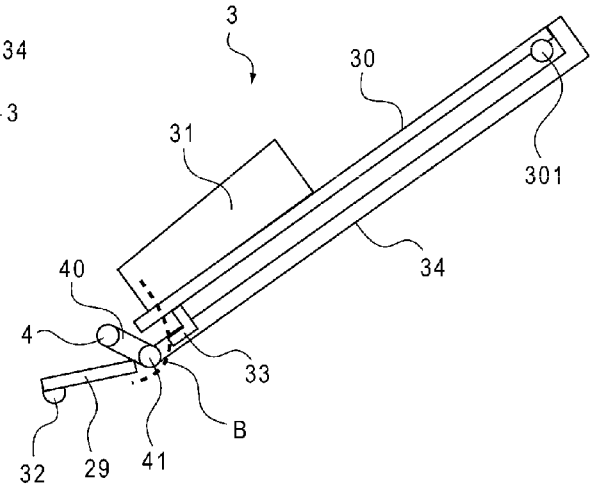
Figure 11C:
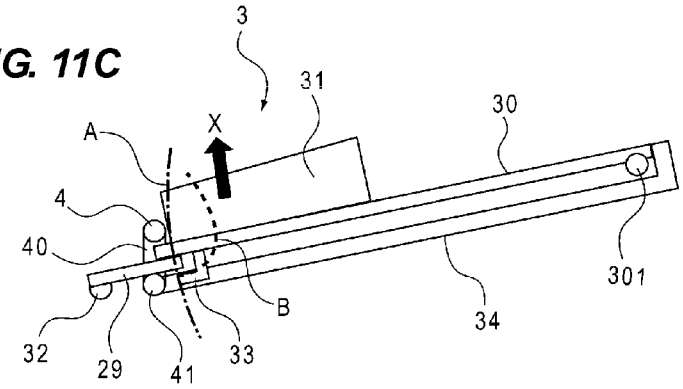

FIGS. 11A, 11B and 11C are diagrams showing processes of an operation of opening the tray unit by rotating the tray unit. When the tray unit 3 is opened from the closed state shown in FIG. 11A, the tray unit 3 is rotated while the opening and closing arm 40 is moved together with the rotation of the tray unit 3. Then, the state is shifted to the fully opened state shown in FIG. 11C via the state of FIG. 11B. At this time, the end portion of the locking portion 33 enters the space below the lifter arm 29 on the movement locus B which has an angle closer to horizontal than that of the first embodiment. That is, as shown in FIG. 11B, the tray unit 3 rotates not only about the unit shaft 4 but also about the second unit shaft 41 from the middle of opening the tray unit 3. As a result, when the tray unit 3 is rotated about the second unit shaft 41, the locking portion 33 does not contact the lifter arm 29 and moves to the space under the lifter arm 29 along the lower surface of the lifter arm 29 located at the first position almost in parallel with the surface of the sheet stacking tray 30.

When the sheet stacking tray 30 rotates about the tray rotation shaft 301 in the state where the locking portion 33 is below the lifter arm 29, the movement locus A of the locking portion 33 is located at the position where the movement locus A intersects (interferes) with the lifter arm 29, which is the same as in the first embodiment. In addition, similarly to the first embodiment, when the sheet stacking tray 30 is opened and closed so as to be accommodated in the apparatus main body 100, the movement locus B of the locking portion 33 is located at the position where the movement locus B does not intersect (interfere) with the lifter arm 29.

In the configuration of the present embodiment, the angle at which the locking portion 33 enters the space under the lifter arm 29 is an angle which is close to parallel with the stacking surface of the sheet stacking tray 30. Therefore, the gap between the locking portion 33 and the lifter arm 29 in the vertical direction of the sheet stacking surface can be made small, which contributes to miniaturization of the apparatus.

Further, when the sheet stacking tray 30 receives a force in the vertical direction X of the sheet stacking surface, the locking portion 33 is engaged with the fixed lifter arm 29 and restricts the rotation. At this time, since the sheet stacking tray 30 rotates only for the gap between the locking portion 33 and the lifter arm 29 and this gap is small, the amount of rotation can be made small.

Third Embodiment

Figure 12:
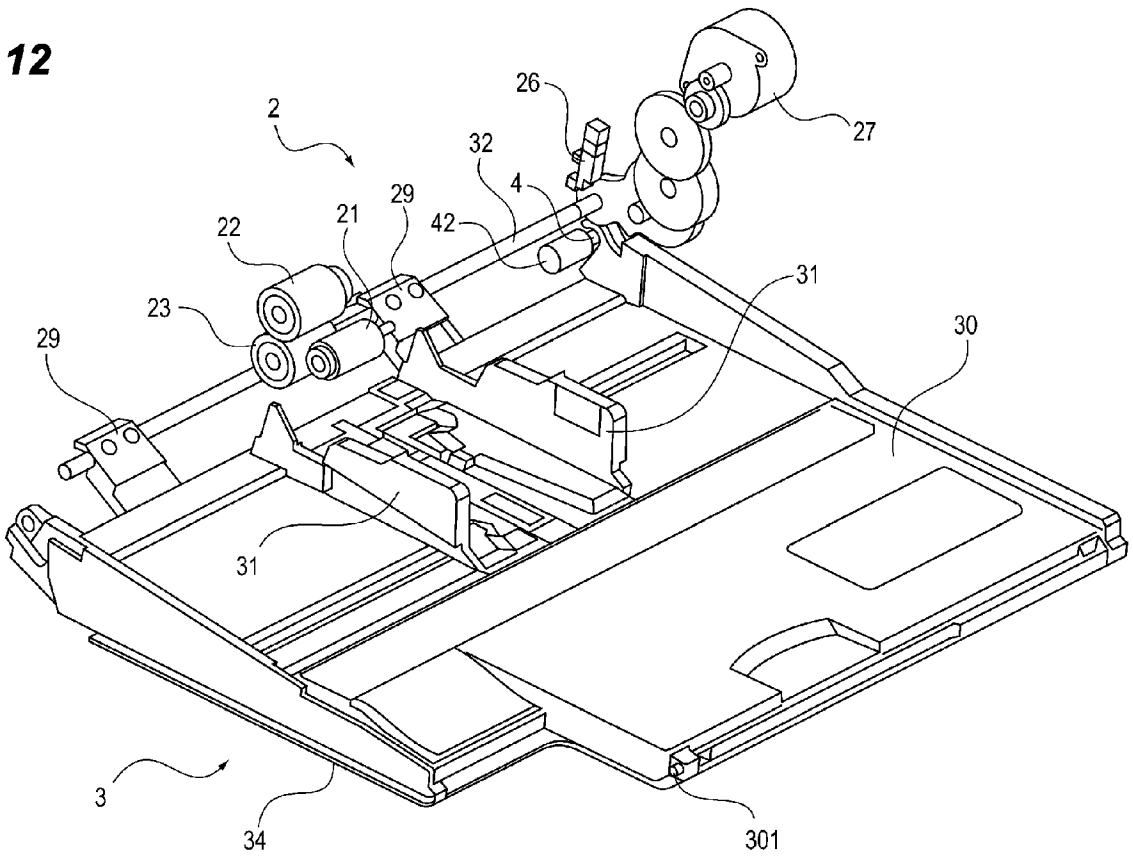
FIG. 12 is an explanatory diagram showing opening and closing operations of the manual tray according to the third embodiment of the present invention.
Figure 13:
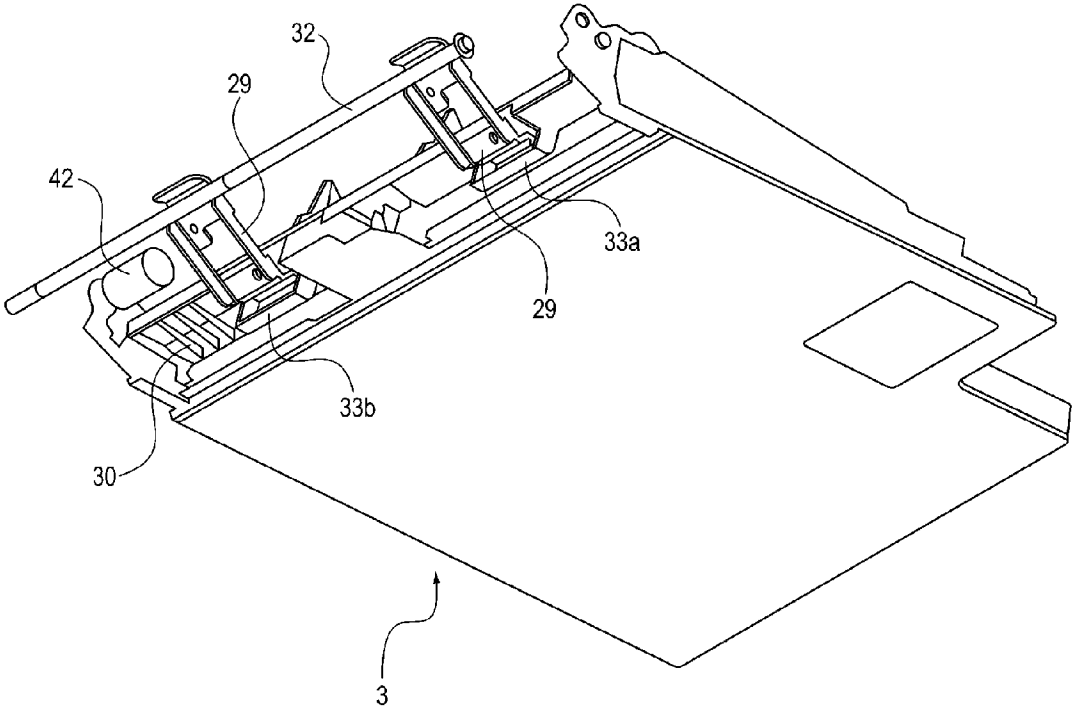
FIG. 13 is a diagram showing a perspective view of a manual sheet feeding portion as viewed from the bottom surface.
Figure 14:
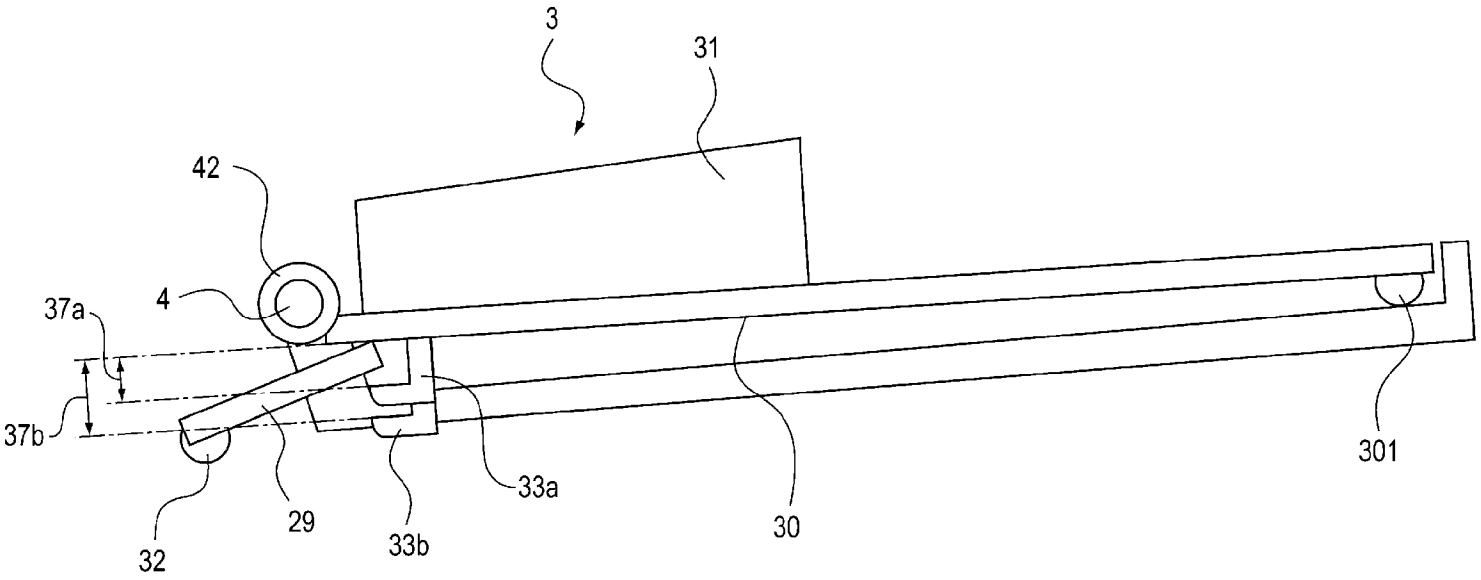
FIG. 14 is a diagram showing a cross-section of the manual sheet feeding portion according to the third embodiment of the present invention in a stand-by state of a feeding operation.

Next, the configuration of the sheet feeding apparatus according to the third embodiment of the present invention will be explained with reference to FIGS. 12 to 14. FIG. 12 is a diagram showing a perspective view of the sheet feeding apparatus according to the third embodiment of the present invention and FIG. 13 is a diagram showing a perspective view of the sheet feeding apparatus as viewed from the bottom side. FIG. 14 is an explanatory diagram showing a cross-sectional view of the sheet feeding apparatus.

In the above-explained manual sheet feeding apparatus according to the first embodiment, the lifter arm 29 is provided at two positions in the sheet width direction intersecting with the sheet feeding direction. Further, the locking portion 33 is also provided at two positions on the lower surface of the sheet stacking tray 30, at which each locking portion 33 is opposed to each lifter arms 29. In the manual sheet feeding apparatus of the first embodiment, the two locking portions 33 have the same shape. Further, the tray unit 3 rotates about the unit shaft 4 to perform an opening and closing operation.

In the present embodiment, the damper (buffering portion) 42 for buffering the opening and closing of the tray unit 3 is provided on the unit shaft 4 on one side in order to suppress the impact when the tray unit 3 is opened and closed. When the tray unit 3 is opened, the load of the damper 42 is applied to the one side of the tray due to the installation of the damper 42, whereby the tray unit 3 is deformed in the torsional direction. As a result, the rotation trajectories on the two locking portions 33 located at both sides in the sheet width direction may be different from each other. Therefore, in the present embodiment, the two locking portions 33*a* and 33*b* which can be engaged with the lifter arm 29 have different shapes from each other. Namely, the pocket shape of the locking portion 33*b* on which side the damper 42 is provided is widened toward the downstream side in the direction in which the tray unit 3 opens with respect to that of the locking portion 33*a* on which side the damper 42 is not provided (see FIGS. 12 and 13).

The configuration of the sheet feeding apparatus according to the present embodiment is the same as that of the first embodiment except that the damper 42 is provided on the unit shaft 4 on the right side among the unit shafts 4 which rotatably support the tray unit 3 and that the two locking portions 33*a* and 33*b* have different shapes each other as explained above.

In the present embodiment, as shown in FIGS. 12 and 13, the damper 42 is provided on the unit shaft 4 on one side. Therefore, when opening the tray unit 3, the load of the damper 42 works as resistance so that the tray unit 3 opens slowly. At this time, the side portion of the tray unit 3 on which the damper 42 is provided moves while lagging behind the side portion of tray unit 3 on which the damper 42 is not provided. As explained above, the load of the damper 42 is applied on one side of the tray and the tray unit 3 is deformed in the torsional direction so that the two locking portions 33*a* and 33*b* on both sides in the sheet width direction have different rotation trajectories each other. That is, the rotation on the side closer to the damper 42 lags slightly behind the rotation on the side farther from the damper 42 due to the rotational load.

Therefore, as shown in FIG. 14, the pocket shape of the locking portion 33*b* on the side on which the damper 42 is provided, which moves while lagging behind is widened toward the downstream side in the opening direction of the tray unit 3. As a result, even when the rotation of the side portion on which the damper 42 is provided lags a little behind the rotation of the side portion on which the damper 42 is not provided in opening the tray unit 3, the lifter arm 29 reliably enters the locking portion 33*b* since the pocket shape of the locking portion 33*b* is widened downward and the engaging region for engaging the lifter arm 29 is wide. Here, the engaging region is defined as the distance between the sheet stacking tray 30 and the locking portion 33*a* (33*b*). In the present embodiment, the distance 37*b* which is the engaging region of the locking portion 33*b* is longer than the distance 37*a* which is the engaging region of the locking portion 33*a*.

As shown in FIG. 12, when the sheet stacking tray 30 receives a force in the upward vertical direction of the sheet stacking surface in the state where the tray unit 3 is opened, the locking portions 33*a* and 33*b* are engaged with the fixed lifter arm 29 thereby restricting the rotation. At this time, the sheet stacking tray 30 rotates only for the gaps between the locking portions 33*a* and 33*b*, and the lifter arm 29. At this time, since the gap between the locking portion 33*a* on the side on which the damper 42 is not provided and the lifter arm 29 is small, the rotation amount can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2016-075235, filed Apr. 4, 2016, which is hereby incorporated by reference herein in its entirety.

What is claimed is:

1. A sheet feeding apparatus comprising:

a tray unit provided rotatably with respect to an apparatus main body, the tray unit being configured to be capable of taking (1) a position at which the tray unit is closed with respect to the apparatus main body and (2) a position at which the tray unit is opened with respect to the apparatus main body;

a feeding portion configured to feed a sheet which is stacked on the sheet stacking member;

a sheet stacking member provided on the tray unit, the sheet stacking member being configured to be capable of being located (1) at a feeding position at which a sheet can be fed by the feeding portion and (2) at a stand-by position which is distant from the feeding position;

a moving portion configured to abut against the sheet stacking member from below and to move the sheet stacking member to the feeding position and to the stand-by position, the moving portion being configured to be movable (1) to a first position at which the moving portion locates the sheet stacking member at the stand-by position and (2) to a second position at which the moving portion locates the sheet stacking member at the feeding position; and a restricting portion provided on the sheet stacking member, the restricting portion being configured to restrict movement of the sheet stacking member from the stand-by position to the feeding position by contacting with the moving portion which is located at the first position when the tray unit is opened.

2. The sheet feeding apparatus according to claim 1, wherein a movement locus of the restricting portion in a case where the tray unit rotates does not contact with the moving portion located at the first position.

3. The sheet feeding apparatus according to claim 1, wherein movement of the moving portion is restricted when the moving portion is located at the first position.

4. The sheet feeding apparatus according to claim 3, wherein the moving portion is drivingly connected to a motor and movement of the moving portion is restricted by the motor when the moving portion is located at the first position.

5. The sheet feeding apparatus according to claim 1, wherein the sheet stacking member is rotatably provided on the tray unit such that the sheet stacking member can be located at the stand-by position and at the feeding position.

6. The sheet feeding apparatus according to claim 1, wherein the tray unit is attached to the apparatus main body via a connecting member, and wherein the connecting member has a first rotating portion about which the connecting member can rotate with respect to the apparatus main body and a second rotating portion about which the connecting member can rotate with respect to the tray unit.

7. The sheet feeding apparatus according to claim 1, wherein the tray unit includes a buffering portion configured to an impact of buffer opening and closing of the tray unit on one side in a sheet width direction which intersects with a sheet feeding direction, and wherein locking portions of the restricting portion, which are capable of engaging the moving portion are provided at two positions in the sheet width direction respectively and an engaging region of a locking portion among the locking portions, which is located closer to the buffering portion is wider than an engaging region of a locking portion among the locking portions, which is located farther from the buffering portion.

8. The sheet feeding apparatus according to claim 1, further comprising a detecting portion configured to detect a position of the moving portion.

9. The sheet feeding apparatus according to claim 1, wherein the restricting portion permits movement of the tray unit from a position at which the tray unit is opened and to a position at which the tray unit is closed in a state in which the moving portion is located at the first position.

10. The sheet feeding apparatus according to claim 1, further comprising a sheet restricting member connected to the sheet stacking member, the sheet restricting member being configured to restrict movement of a sheet stacked on the sheet stacking member in a direction which intersects with a sheet feeding direction of the sheet.

11. The sheet feeding apparatus according to claim 10, wherein a center of rotation of the sheet stacking member is provided upstream in the sheet feeding direction with respect to the sheet restricting member.

12. A sheet feeding apparatus comprising:

a tray unit which includes a sheet stacking tray on which a sheet is stacked and a bottom portion configured to rotatably support the sheet stacking tray and to be rotatable with respect to an apparatus main body, the tray unit being configured to be capable of taking (1) a position at which the tray unit is opened with respect to the apparatus main body and (2) a position at which the tray unit is closed with respect to the apparatus main body by rotating the bottom portion;

a feeding portion configured to feed a sheet which is stacked on the sheet stacking tray;

a lifter arm configured to abut against the sheet stacking tray from below and to move the sheet stacking tray such that the sheet stacking tray can be located (1) at a stand-by position and (2) at a feeding position at which a sheet can be fed, the feeding position being located above the stand-by position;

a motor configured to drivingly connected to the lifter arm; and a restricting portion provided on the sheet stacking tray, the restricting portion being configured to restrict rotation of the sheet stacking tray by contacting with the lifter arm when the tray unit is opened with respect to the apparatus main body.

13. An image forming apparatus comprising:

a sheet feeding apparatus; and an image forming apparatus configured to form an image on a sheet fed by a sheet feeding apparatus, wherein the sheet feeding apparatus includes (a) a tray unit provided rotatably with respect to an apparatus main body, the tray unit being configured to be capable of taking (1) a position at which the tray unit is closed with respect to the apparatus main body and (2) a position at which the tray unit is opened with respect to the apparatus main body;

(b) a sheet stacking member provided on the tray unit, the sheet stacking member being configured to be capable of being located (1) at a feeding position at which a sheet can be fed and (2) at a stand-by position which is distant from the feeding position;

(c) a feeding portion configured to feed a sheet which is stacked on the sheet stacking member;

(d) a moving portion configured to abut against the sheet stacking member from below and to move the sheet stacking member to the feeding position and to the stand-by position, the moving portion being configured to be movable (1) to a first position at which the moving portion locates the sheet stacking member at the stand-by position and (2) to a second position at which the moving portion locates the sheet stacking member at the feeding position; and (e) a restricting portion provided on the sheet stacking member, the restricting portion being configured to restrict movement of the sheet stacking member from the stand-by position to the feeding position by contacting with the moving portion which is located at the first position when the tray unit is opened.

* * * * *